United States Patent [19]

Ohbu et al.

[11] 4,235,759

[45] Nov. 25, 1980

[54] LIQUID DETERGENT COMPOSITIONS

[75] Inventors: Kazuo Ohbu, Tokyo; Nobuo Johna, Funabashi; Ichirō Kashiwa, Kunitachi, all of Japan

[73] Assignee: The Lion Fat & Oil Co., Ltd., Tokyo, Japan

[21] Appl. No.: 45,134

[22] Filed: Jun. 4, 1979

[30] Foreign Application Priority Data

Jun. 7, 1978 [JP] Japan ..... 53/68534

[51] Int. Cl.[3] ..... C11D 1/65

[52] U.S. Cl. ..... 252/545; 252/547; 252/551; 252/DIG. 14

[58] Field of Search ..... 252/532, 545, 547, 551, 252/DIG. 14

[56] References Cited

U.S. PATENT DOCUMENTS

| | | | |
|---|---|---|---|
| 4,132,678 | 1/1979 | Iijima et al. | 252/545 |

FOREIGN PATENT DOCUMENTS

| | | | |
|---|---|---|---|
| 2341592 | 2/1975 | Fed. Rep. of Germany | 252/547 |
| 759837 | 10/1956 | United Kingdom | 252/547 |
| 1050791 | 12/1966 | United Kingdom . | |
| 1232698 | 5/1971 | United Kingdom . | |
| 1261231 | 1/1972 | United Kingdom | 252/547 |

*Primary Examiner*—P. E. Willis, Jr.

*Attorney, Agent, or Firm*—Blanchard, Flynn, Thiel, Boutell & Tanis

[57] ABSTRACT

A liquid detergent composition which comprises an anionic surface active agent of polyoxyalkylene alkyl ether sulfate type and a cationic surface active agent of mono-long chain alkyl quaternary ammonium salt type at a mol ratio of the former to the latter in the range of from 8:1 to 1:1 is not only mild to the human skin but also capable of demonstrating superb detergency.

5 Claims, No Drawings

LIQUID DETERGENT COMPOSITIONS

BACKGROUND OF THE INVENTION

The present invention relates to a liquid detergent composition, and to be precise, it relates to a liquid detergent composition which is mild on the human skin and is superior in detergency, oil-solubilizing power and solution stability.

As a liquid detergent composition in the prior art, there is known a composition prepared by mixing alkylbenzene sulfonate with N-acylaminoacid or the like (See Japanese Patent Publication No. 4256/1971). This liquid detergent is intended to make the best use of the superior detergency of the alkylbenzene sulfonate while alleviating the skin-irritating property inherent in said surface active agent by means of N-acylaminoacid or the like, but the anticipated result is not necessarily realized thereby. On the other hand, as a liquid detergent composition having a lower skin-irritating property, there is known a composition prepared by mixing N-acyl glutamate with alkyl betaine or amine oxide. However, this liquid detergent is not free from the defect that it is insufficient in detergency and oil-solubilizing power.

In short, in liquid detergents, the detergency and the skin-irritating property are generally inconsistent with each other, and in the prior art, it has been practically impossible to make high detergency compatible with low skin-irritating property. The inventors have made a series of studies aiming at developing a liquid detergent having superior detergency and a minimum skin-irritating property, and as a result, they have come to a finding that, when an anionic surface active agent of the polyoxyalkylene alkyl ether sulfate type and a cationic surface active agent of a specific quaternary ammomium salt type are compounded at a specific mol ratio and in specific quantities, the resulting liquid detergent composition is mild on the skin and is nevertheless superior in detergency, oil-solubilizing power and solution stability.

In this connection, the conception of combining a polyoxyalkylene alkyl ether sulfate and a cationic surface active agent of quaternary ammonium salt type is disclosed in Japanese Unexamined Patent Publication No. 35203/1977 on a transparent liquid shampoo, but the combination of an anionic surface active agent and a cationic surface active agent disclosed therein utterly differs from that in the present invention in respect of the number of carbon atoms of the long-chain alkyl radical in the cationic surface active agent employed.

SUMMARY OF THE INVENTION

The present invention provides a liquid detergent composition which comprises an anionic surface active agent (A) expressed by the following formula (I) and a cationic surface active agent (B) of the quaternary ammonium salt type expressed by the following formula (II) at a mol ratio of (A) to (B) in the range of from 8:1 to 1:1, provided that the total amount of said surface active agents (A) and (B) should account for 1 to 40% by weight of the composition:

$$R'O(\overset{\overset{R''}{|}}{C}HCH_2O)_mSO_3M \qquad (I)$$

-continued

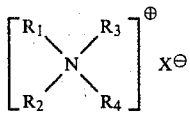

(II)

wherein R′ represents alkyl radical having 8 to 16 carbon atoms, R″ represents H or $CH_3$, m represents an average number of mols of alkylene oxide added which is in the range of from 1 to 6, M represents alkali metal, ammonium or organic amine, $R_1$ represents alkyl radical having 8 to 14 carbon atom, $R_2$ and $R_3$ represent $CH_3$, $C_2H_4OH$ or $(C_2H_4O)_2H$, $R_4$ represents $CH_3$, $C_2H_4OH$, $(C_2H_4O)_2H$ or benzyl radical, and X represents halogen, $CH_3SO_4$ or $C_2H_5SO_4$.

DETAILED DESCRIPTION OF THE INVENTION

Generally speaking, on the occasion of using an anionic surface active agent together with a cationic surface active agent, it is easily conceivable that, inasmuch as the polar groups of both agents are oppositely charged, there will be formed a mixed micellelike complex as a result of electrostatic coupling. However, the fact that a satisfactory result is obtained rather by applying a specific range of mol ratio wherein an excess anionic surface active agent is present than by applying electrostatic charge neutralizing conditions, as seen in the present invention, is presumably attributable to the combined use of specific surface active agents such as respectively expressed by the foregoing formulas (I) and (II) as anionic surface active agent and cationic surface active agent, coupled with a moderate electrostatic interaction between the polar groups of both surface active agents, which entail manifestation of unique synergistic effects in respect of detergency, oil-solubilizing power and skin-irritating property.

Polyoxyalkylene alkyl ether sulfate for use in the present invention is expressed by the formula (I), and this surface active agent can be manufactured by the procedure comprising first preparing polyoxyalkylene alkyl ether by adding 1 to 6 moles of ethylene oxide or propylene oxide on the average to an aliphatic saturated alcohol having 8 to 16 carbon atoms in the presence of an alkali catalyst, next sulfating the thus obtained polyoxyalkylene alkyl ether with chlorosulfonic acid or sulfur trioxide by the conventional method, and thereafter neutralizing the resulting product with an alkali metal hydroxide, ammonia or an organic amine. To cite polyoxyalkylene alkyl ether sulfates suitable for use in the present invention, there are sulfates of an alkyl ether obtained by adding 3 moles of ethylene oxide on the average to a natural lauryl alcohol, an alkyl ether obtained by adding 3 moles of ethylene oxide on the average to an aliphatic saturated alcohol having 11 to 15 carbon atoms, and an alkyl ether obtained by adding 2 moles of ethylene oxide on the average to an aliphatic saturated alcohol having 12 to 13 carbon atoms, etc.

Quaternary ammonium salts for use as the cationic surface active agent in the present invention are expressed by the formula (II), and they can be manufactured by the conventional method. To cite typical quaternary ammonium salts useful for the present invention, there are octyltrimethyl ammonium chloride, lauryltrimethyl ammonium methosulfate, lauryldimethylbenzyl ammonium chloride, myristyltrimethyl ammonium chloride, etc. with the addition of coco ($C_{12}$–$C_{14}$)- alkyltrimethyl ammonium chloride. For the cationic surface active agent of the quaternary ammonium salt type for use in the present invention, it is important to have one long-chain alkyl group, of which the number of carbon atoms is in the range of from 8 to 14. In the case of a cationic surface active agent of the quaternary ammonium salt type which fails to satisfy this requisite, even if it satisfies the condition of mol ratio as described later on and is used jointly with an anionic surface active agent, it will not produce satisfactory results. Therefore, quaternary ammonium salts of the mono-long chain alkyl type, quaternary ammonium salts of the di-long chain alkyl type, etc. whose long-chain alkyl radical has carbon atoms outside the range of from 8 to 14 are not applicable to the present invention.

A liquid detergent composition according to the present invention comprises an anionic surface active agent (A) expressed by the formula (I) and a cationic surface active agent (B) expressed by the formula (II) at a mol ratio of (A) to (B) in the range of from 8:1 to 1:1, preferably from 4:1 to 1:1. In the case where the mol ratio of (A) to (B) exceeds 8:1, it is impossible for the composition to maintain a mild effect on the skin, while in the case where said mol ratio is less than 1:1, a satisfactory detergency as well as oil-solubilizing power cannot be expected of the composition. In a liquid detergent composition according to the present invention, the total amount of the surface active agents (A) and (B) must account for 1 to 40% by weight, preferably 5 to 25% by weight, of the whole composition. In the case where this amount is less than 1% by weight, the function of the composition as a liquid detergent comes to be unsatisfactory, while in the case where it exceeds 40% by weight, not only does the solution stability of the composition deteriorate, but also the dispersibility and/or the solubility of the composition in water is lower at the time of use thereof.

As a liquid detergent composition of the present invention, it is desirable to maintain its pH value in the range of from 5 to 8. The reason is that, inasmuch as the isoelectric point of the dermal protein is in the range of from 5 to 8 in terms of pH value, when a composition is of a pH value deviating from this range, its skin-irritating property is enhanced.

A liquid detergent composition of the present invention can contain some other ingredients, builder, solubilizer, pH controlling agent, stabilizer, perfume, coloring matter and so forth which are prevalently employed for conventional liquid detergents, in addition to the surface active agents (A) and (B) as indispensable ingredients.

A liquid detergent composition of the present invention which comprises the surface active agents (A) and (B) at a specific mol ratio and in a specific total amount is not only mild on the skin, but also is superior in detergency as well as oil-solubilizing power, and promises satisfactory results in respect of the liquid property too.

Further elucidation of the present invention will be hereunder given in the concrete with reference to some examples embodying the invention, and before that, the method for evaluation of the efficiency of liquid detergent compositions adopted in the respective examples will be first explained.

Evaluation of solution stability (stability at low temperature)

A sample was preserved for one month within a temperature controlled bath maintained at a temperature of −5° C. Thereafter, the temperature was restored to room temperature, and the appearance of the sample was examined with the naked eye, whereby the solution stability of the sample was evaluated on the following criteria:

o: uniform transparency
Δ: slight precipitate
x: considerable precipitate

Evaluation of detergency

A bath solution of 0.15% in concentration of a sample detergent, 3 l in volume and 25° C. in liquid temperature was prepared. Then, in a vat containing this bath solution, plates soiled with butter (0.5 g per plate) which was previously dyed with Oil Red were washed by rubbing the surface of each plate 3 times and the back thereof 3 times with a sponge. Thereafter, the presence of residual oily matter on each plate was determined by inspecting the red colored spot, and the detergency of the sample was evaluated by the number of plates which were completely cleansed.

Evaluation of skin-irritating property

By employing a 6-member panel consisting of 3 men and 3 women, an experiment was conducted over a 2-day period by dipping one hand of each member in a detergent solution of 1% in concentration of a sample detergent and 35° C. in temperature while dipping the other hand of each member in water for 30 minutes per day. Thereafter, by comparing the hand dipped in the detergent solution (A) with the hand dipped in water (B), the condition of skin roughness of both hands was observed and graded on the following criteria:

roughness of hand A is remarkably less than that of hand B: ——2
roughness of hand A is somewhat less than that of hand B: ——1
roughness of hand A is equal to that of hand B: —0
roughness of hand A is somewhat more severe than that of hand B: —+1
roughness of hand A is remarkably more severe than that of hand B: —+2

EXAMPLE 1.

By employing sodium polyoxyethylene alkyl ether sulfate, in which the alkyl chain has 12 to 13 carbon atoms and the average number of added moles of ethylene oxide is 3 (AES, F=3), as anionic surface active agent and various quaternary ammonium chlorides which are different in the kind of groups coupled with nitrogen as cationic surface active agent, a variety of liquid detergent compositions consisting of the ingredients shown in the upper column of Table 1 were prepared. Next, the efficiency of the respective compositions was evaluated through the aforementioned procedure. The result of this evaluation was as shown in the lower column of Table 1. In this connection, as for the cationic surface active agent, only the groups coupling with nitrogen was shown in the table.

TABLE 1

| | Composition No. | | | | | | | | |
|---|---|---|---|---|---|---|---|---|---|
| | 1 | 2 | 3 | 4 | 5 | 6 | 7 | 8 | 9 |
| Ingredient (wt.%) | | | | | | | | | |
| AES, F=3 | 30 | — | 25 | 25 | 25 | 25 | 25 | 25 | 25 |
| $C_{16}$ dialkyldimethyl | — | — | 5 | — | — | — | — | — | — |
| $C_{12}$ dialkyldimethyl | — | — | — | 5 | — | — | — | — | — |
| $C_6$ alkyltrimethyl | — | — | — | — | 5 | — | — | — | — |
| $C_8$ alkyltrimethyl | — | — | — | — | — | 5 | — | — | — |
| $C_{12}$ alkyltrimethyl | — | 5 | — | — | — | — | 5 | — | — |
| $C_{14}$ alkyltrimethyl | — | — | — | — | — | — | — | 5 | — |
| $C_{16}$ alkyltrimethyl | — | — | — | — | — | — | — | — | 5 |
| ethanol | 5 | 5 | 5 | 5 | 5 | 5 | 5 | 5 | 5 |
| water | | | | | balance | | | | |
| mol ratio (anion/cation) | — | — | 6.2 | 4.9 | 2.1 | 2.4 | 3.1 | 3.4 | 3.7 |
| Efficiency | | | | | | | | | |
| solution stability | o | o | x | x | o | o | o | o | x |
| detergency | 8 | 0* | 2 | 2 | 4 | 11 | 13 | 14 | 6 |
| skin-irritating property | +1.7 | +0.7 | +1.6 | +1.6 | +0.5 | +0.1 | +0.2 | +0.2 | +1.3 |

*Said with oil on the first plate failed to be completely cleansed.

As is evident from the results shown in Table 1, composition Nos. 6 through 8 corresponding to liquid detergent compositions of the present invention bring about satisfactory results in all respects of solution stability, detergency and skin-irritating property, while such good results cannot be expected of composition Nos. 1 through 5 and No. 9.

EXAMPLE 2.

After preparing a variety of liquid detergent compositions by employing sodium polyoxyethylene alkyl ether sulfate, in which the alkyl radical has 12 to 13 carbon atoms and the average number of moles added to ethylene oxide is 2 (AES, F=2), as anionic surface active agent, and $C_{12}$-alkyltrimethyl ammonium chloride ($C_{12}$ ATMA) as cationic surface active agent, the efficiency of the respective compositions was evaluated through the same procedure as in Example 1. The ingredients of the respective compositions were as shown in the upper column of Table 2, and the results of the evaluation were as shown in the lower column of the same table.

TABLE 2

| | Composition No. | | | | | |
|---|---|---|---|---|---|---|
| | 10 | 11 | 12 | 13 | 14 | 15 |
| Ingredient (wt.%) | | | | | | |
| AES, F=2 | 28 | 27.5 | 26.5 | 25 | 21 | 16.5 |
| $C_{12}$ ATMA | 2 | 2.5 | 3.5 | 5 | 9 | 13.5 |
| ethanol | 5 | 5 | 5 | 5 | 5 | 5 |
| water | | | | balance | | |
| mol ratio (anion/cation) | 9 | 7 | 5 | 3 | 1.5 | 0.75 |
| Efficiency | | | | | | |
| solution stability | o | o | o | o | o | Δ |
| detergency | 9 | 11 | 12 | 13 | 11 | 8 |
| skin-irritating property | +1.4 | +0.2 | +0.1 | +0.2 | +0.3 | +0.8 |

The results shown in Table 3 show to that the mol ratio of anionic surface active agent to cationic surface active agent constitutes a matter of importance in order to provide a composition with superior liquid property as well as detergency and mildness in skin-irritating property. In this connection, as for composition Nos. 10 and 15, said mol ratio deviates from the range defined for the present invention.

EXAMPLE 3.

After preparing a variety of liquid detergent compositions by employing various kinds of the anionic surface active agent and cationic surface active agent, the efficiency of the respective compositions was evaluated. The ingredients of the respective compositions were as shown in the upper column of the following Table 3, and the results of the evaluation were as shown in the lower column of the same table.

AES, F=1; sodium polyoxyethylene alkyl ether sulfate, in which the alkyl radical has 12 to 13 carbon atoms and the average number of mols of added ethylene oxide is 1.

$C_{12}$ ABS; sodium alkylbenzene sulfonate, in which alkyl chain has 12 carbon atoms.

$C_{12}$ ATMA; alkyltrimethyl ammonium chloride, in which alkyl chain has 12 carbon atoms.

$C_{12}$ ADBA; alkyldimethyl benzyl ammonium chloride, in which alkyl radical has 12 carbon atoms.

$C_{12}$ ADHA; alkyldimethyl hydroxyethyl ammonium chloride, in which alkyl radical has 12 carbon atoms.

$C_{12}$ DAHA; dialkylmethyl hydroxyethyl ammonium chloride, in which alkyl radical has 12 carbon atoms.

TABLE 3

| | Composition No. | | | |
|---|---|---|---|---|
| | 16 | 17 | 18 | 19 |
| Ingredient (wt.%) | | | | |
| AES, F=1 | — | 25 | 25 | 25 |
| $C_{12}$ ABS | 25 | — | — | — |
| $C_{12}$ ATMA | 5 | — | — | — |
| $C_{12}$ ADBA | — | 5 | — | — |
| $C_{12}$ ADHA | — | — | 5 | — |
| $C_{12}$ DAHA | — | — | — | 5 |
| ethanol | 5 | 5 | 5 | 5 |
| water | | balance | | |
| mol ratio (anion/cation) | 3.8 | 4.8 | 4.1 | 6.4 |
| Efficiency | | | | |
| solution stability | x | o | o | x |
| detergency | 6 | 12 | 13 | 5 |
| skin-irritating property | +2.0 | +0.2 | 0.0 | +1.4 |

As is evident from the showings in Table 3, in order to provide a liquid detergent composition with superior liquid property as well as detergency and mildness in skin-irritating property, of course the mol ratio of the anionic surface active agent to the cationic surface active agent in the composition is of importance, but what kind of surface active agents should be selected as anionic surface active agent and cationic surface active agent is a matter of importance. Composition Nos. 16 and 19 prepared by combining anionic surface active agents different from that defined in the present invention with cationic surface active agents different from that in the present invention can produce no more than unsatisfactory results in respects of solution stability, detergency and skin-irritating property.

What is claimed is:

1. A liquid detergent composition in which the synthetic organic surfactant component consists essentially of a mixture of A. anionic surfactant having the formula $$R'O(\overset{\overset{R''}{|}}{C}HCH_2O)_mSO_3M$$

wherein R′ is alkyl having 8 to 16 carbon atoms, R″ is H or $CH_3$, m is the average number of mols of added $$-\overset{\overset{R''}{|}}{C}HCH_2O-$$

units and is in the range of from 1 to 6 and M is an alkali metal, ammonium or alkanolamine B. cationic surfactant having the formula

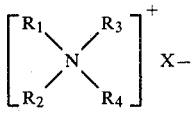

wherein $R_1$ is alkyl having 8 to 14 carbon atoms, $R_2$ and $R_3$ are $CH_3$, $C_2H_4OH$ or $(C_2H_4O)_2H$, $R_4$ is $CH_3$, $C_2H_4OH$, $(C_2H_4O)_2H$ or benzyl, and X is halogen, $CH_3SO_4$ or $C_2H_5SO_4$, the molar ratio of A:B being in the range of from 8:1 to 1:1, and the total weight of A plus B being from 1 to 40% by weight, based on the weight of said composition.

2. A liquid detergent composition according to claim 1 or claim 3, wherein the pH value of the composition is in the range of from 5 to 8.

3. A liquid detergent composition as claimed in claim 1 in which the balance of said composition consists essentially of water.

4. A liquid detergent composition according to claim 1 or claim 3, wherein the mol ratio of A:B is in the range of from 4:1 to 1:1.

5. A liquid detergent composition according to claim 4, wherein the total amount of A plus B is in the range of from 5 to 25% by weight, based on the weight of the composition.

* * * * *